US005911638A

United States Patent [19]

Parente et al.

[11] Patent Number: 5,911,638

[45] Date of Patent: Jun. 15, 1999

[54] GOLF CLUB HEAD WITH ADJUSTABLE WEIGHTING

[75] Inventors: Richard E. Parente, San Diego; Richard De La Cruz, Pauma Valley; Danny C. Ashcraft, Vista, all of Calif.

[73] Assignee: Goldwin Golf USA, Inc., Carlsbad, Calif.

[21] Appl. No.: 08/270,910

[22] Filed: Jul. 5, 1994

[51] Int. Cl.[6] ..... A63B 53/04

[52] U.S. Cl. ..... 473/338; 473/345; 473/409

[58] Field of Search ..... 473/324, 328, 473/334, 335, 336, 337, 338, 339, 342, 344, 345, 346, 349, 350, 256, 219, 409

[56] References Cited

U.S. PATENT DOCUMENTS

| | | | |
|---|---|---|---|
| 1,167,106 | 1/1916 | Palmer . | |
| 1,235,922 | 8/1917 | Pittar . | |
| 1,269,745 | 6/1918 | Robertson . | |
| 1,526,438 | 2/1925 | Scott . | |
| 1,568,888 | 1/1926 | Dunn . | |
| 1,582,836 | 4/1926 | Link . | |
| 1,601,770 | 10/1926 | Reach et al. . | |
| 1,616,920 | 2/1927 | Pedersen . | |
| 1,968,092 | 7/1934 | Oldham . | |
| 2,056,335 | 10/1936 | Wettlaufer | 273/171 |
| 2,067,556 | 1/1937 | Wettlaufer . | |
| 2,171,383 | 8/1939 | Wettlaufer . | |
| 2,447,967 | 8/1948 | Stone . | |
| 3,191,936 | 6/1965 | Guier . | |
| 3,212,783 | 10/1965 | Bradley et al. . | |
| 3,466,047 | 9/1969 | Rodia | 273/171 |
| 3,556,533 | 1/1971 | Hollis | 273/171 |
| 3,819,181 | 6/1974 | Mills . | |
| 3,941,390 | 3/1976 | Hussey . | |
| 3,967,826 | 7/1976 | Judice . | |
| 3,976,299 | 8/1976 | Lawrence et al. . | |
| 3,995,865 | 12/1976 | Cochran et al. . | |
| 4,021,047 | 5/1977 | Mader . | |
| 4,063,737 | 12/1977 | Tom et al. . | |
| 4,206,924 | 6/1980 | Koralik | 273/169 |
| 4,214,754 | 7/1980 | Zebelean . | |
| 4,429,879 | 2/1984 | Schmidt . | |
| 4,438,931 | 3/1984 | Motomiya . | |
| 4,867,458 | 9/1989 | Sumikawa | 273/171 |
| 5,090,702 | 2/1992 | Viste . | |
| 5,232,224 | 8/1993 | Zeider . | |

FOREIGN PATENT DOCUMENTS

| | | |
|---|---|---|
| 211781 | 12/1957 | Australia . |
| 371974 | 5/1932 | United Kingdom . |
| 398643 | 9/1933 | United Kingdom . |
| 679292 | 9/1952 | United Kingdom . |
| 1476889 | 6/1977 | United Kingdom . |

*Primary Examiner*—Sebastiano Passaniti
*Attorney, Agent, or Firm*—Cooley Godward LLP; Craig P. Opperman

[57] ABSTRACT

A golf club head has a body having a front, striking face, an upper wall, a lower face with a plurality of threaded openings at selected positions, a rear wall, a heel and a toe, and a separate sole plate for securing to the lower face of the body. The sole plate has a plurality of through bores aligned with the openings, through which fastener screws project to secure the sole plate to the body. The fastener screws are selected from a plurality of sets of screws of different weights, whereby each fastener screw may be selected from any one of the sets to control total head weight and weight distribution.

11 Claims, 1 Drawing Sheet

GOLF CLUB HEAD WITH ADJUSTABLE WEIGHTING

BACKGROUND OF THE INVENTION

The present invention relates generally to golf club heads, and is particularly concerned with the provision of adjustable weighting in a golf club head.

Golf clubs are generally divided into four main types, comprising putters, irons, fairway clubs and drivers. Drivers in the past were normally made of wood, and so were normally referred to as "woods." More recently, such drivers have been made of metal, normally investment cast stainless steel, and are often referred to as "metal woods." Each category of golf club is made in a range of different sizes and weights to accommodate different player's requirements and playing conditions.

One important factor in determining performance of any type of golf club is the distribution of weight around the head while providing the correct total weight for that particular club. Weight distribution about the head will control the position of the center of gravity of the club and is considered to control the position and size of the so-called "sweet spot," or the area on the front or ball striking face of the club on which the ball should be struck to produce the 'most accurate results. Thus, it is often considered desirable to add weight at the heel and toe, for example, in order to produce a larger sweet spot.

Various weighting arrangements have been proposed in the past in order to provide the desired weight distribution and to vary the weight distribution between different clubs in order to accommodate different player's requirements, e.g. beginning golfers or professionals. In some cases, weighted inserts are embedded in the head at appropriate positions to provide the desired weight distribution, for example as described in U.S. Pat. No. 3,995,865 of Cochran et al., or by adding lead powder in a foam filling to the central cavity of a hollow club head. Some heads have internal cavities in which weights such as lead slugs may be placed in order to suit the needs of different golfers. Where the cavity is accessible, for example via a removable sole or crown plate, the same club may be adjusted for different golfers. In U.S. Pat. No. 3,976,299 of Lawrence et al., adjustable weights or plugs are disposed adjacent the face of the club head in tapped apertures extending through the sole of the club head. The plugs may be moved along the length of the aperture in order to adjust weight distribution. In other clubs, lead or brass weights are secured at the end of the club shaft to bring the club to the desired swing weight.

SUMMARY OF THE INVENTION

It is an object of the present invention to provide a new and improved golf club head with adjustable weighting.

According to the present invention a golf club head is provided which comprises a body having a front, striking face, an upper wall, a lower wall, a rear wall, a heel and a toe, the lower wall having a number of threaded openings at selected positions, a separate sole plate for securing to the lower wall of the body, the sole plate having an equal number of through bores positioned for alignment with the respective openings in the lower wall when the sole plate is located against the lower wall, and a plurality of screws for extending through the respective through bores for threaded engagement in the aligned threaded openings, the screws including sets of screws of different weights, whereby the screw weight at each position in the lower wall and sole plate can be selected in order to control the total club head weight and the weight distribution across the club head.

Thus, screws from the same set can be used to secure the sole plate to the lower wall at each of the threaded opening positions, with the set selected controlling the club head weight, or screws from different sets may be used so that the screw weight at each position is different, in order to produce a different weight distribution. The screws may be changed readily until the optimum weighting for a particular golfer is achieved.

Preferably, the screws in different sets are of different lengths to provide the difference in weight from set to set. The screw length may range from a minimum of ¼ inch and a weight of 2 grams to a maximum of 1 inch and a weight of 5 grams. Preferably, the threaded holes in the lower wall comprise three holes located at the heel, toe and rear of the body, respectively. Since a weight change of 2 grams is equal to one swing weight in golf club heads, and three screws will be used to attach the sole plate to the lower wall, it can be seen that this system allows the swing weight of the same club to be adjusted by an amount of the order of five swing weights, or ten grams. Additionally, by using heavier screws at the heel, toe or rear, weight can be selectively adjusted from toe to heel or front to back of the club head, as desired for the particular golfer.

In the preferred embodiment of the invention, the body has an empty internal cavity and the threaded holes are through holes in the lower wall extending into the cavity. Thus, the end of each screw will extend into the cavity, and different length screws can easily be used, with the only limitation in screw length being the total height of the cavity.

The club head is preferably of the metal wood type although the same adjustable weighting system may be used on any type of golf club, including putters, irons and fairway clubs as well as drivers. The screws serve both to attach the sole plate to the lower wall and to provide the required total club weight and the desired weight distribution, without requiring additional lead slugs or other more complex weighting systems which add to the expense of the club. The screws can be changed quickly and easily as desired to adjust head weight and weight distribution, allowing a head to be fine tuned to a particular golfer's requirements.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
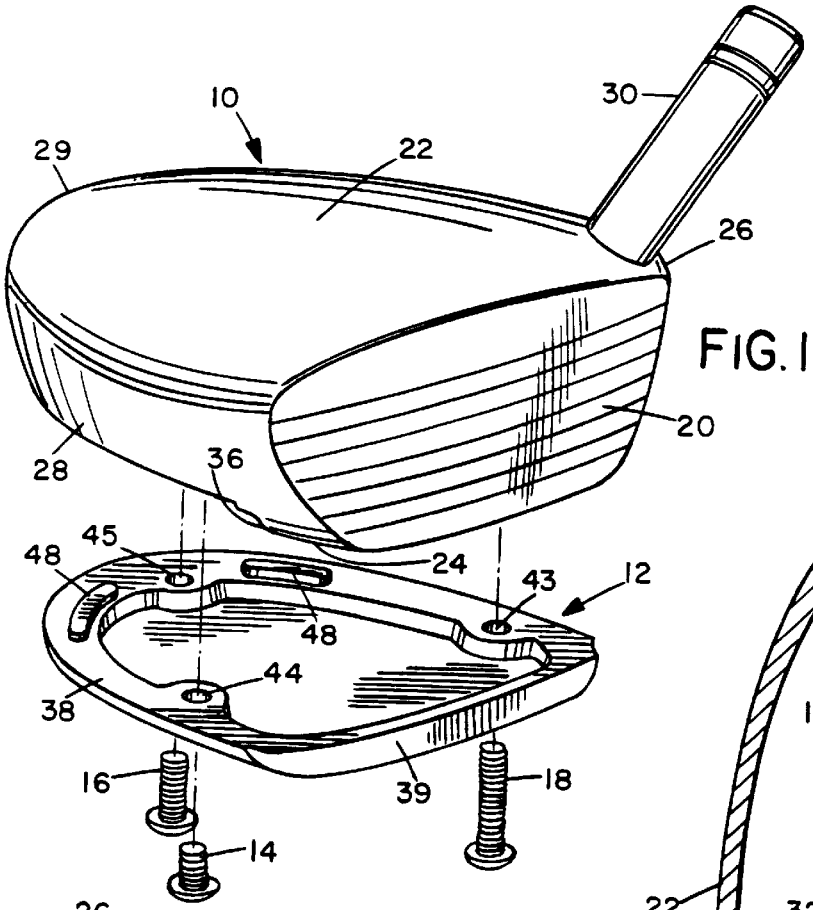
FIG. 1 is a perspective view of a golf club head incorporating an adjustable weighting system according to a preferred embodiment of the invention, with the sole plate separated and showing the different lengths of screws.

As illustrated in FIG. 1, a golf club head with an adjustable weighting system according to a preferred embodiment of the present invention includes a body 10 and a separate sole plate 12 which is securable to the body 10 via different length screws 14,16,18. In the illustrated embodiment, the golf club head is a metal wood which is manufactured as described in our co-pending application Ser. No. 08/159,738 filed Nov. 30, 1993, the contents of which are incorporated herein by reference, and the sole plate 12 is secured in a machined recess in the body in which it has an interference or interlocking fit, as described on our co-pending application entitled "Golf Club Head with Interlocking Sole Plate" filed on even date herewith, the contents of which are also incorporated herein by reference. However, it will be understood that the same adjustable weighting system can be used on any golf club head of any type of golf club, not only metal wood drivers, and not only a driver as illustrated in the accompanying drawings.

The body 10 has a front, striking face 20, an upper wall or crown 22, a lower wall 24, a heel 26, a toe 28, and a rear wall 29. A hosel or tube neck 30 for receiving the end of a golf club shaft is secured in a bore extending through the upper wall 22 adjacent heel 24 and into the body 10, preferably as described in our co-pending application entitled "Golf Club Head" filed on even date herewith, the contents of which are incorporated herein by reference. The body 10 has an empty internal cavity 32 and an opening 34 in lower wall 24 leads into the cavity. Preferably, the lower wall is recessed inwardly to form an inwardly projecting rim or face 36 behind front face 20 and a substantially flat, rearwardly extending face or rim 37 surrounding opening 34. The sole plate 12 is shaped and dimensioned to be a mating fit in the recessed area of the lower wall 24, with a flat inner wall 38 for mating engagement with rim 37 and a front face 39 shaped for mating engagement with inwardly projecting rim 36, as described in our co-pending application entitled "Golf Club Head with Interlocking Sole Plate," referred to above. The sole plate thus forms the majority of the lower surface of the golf club.

Figure 3:
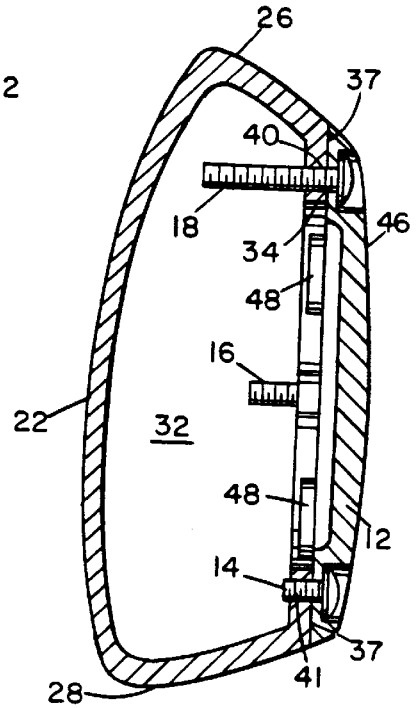
FIG. 3 is a sectional view taken on line 3—3 of FIG. 2.
Figure 2:
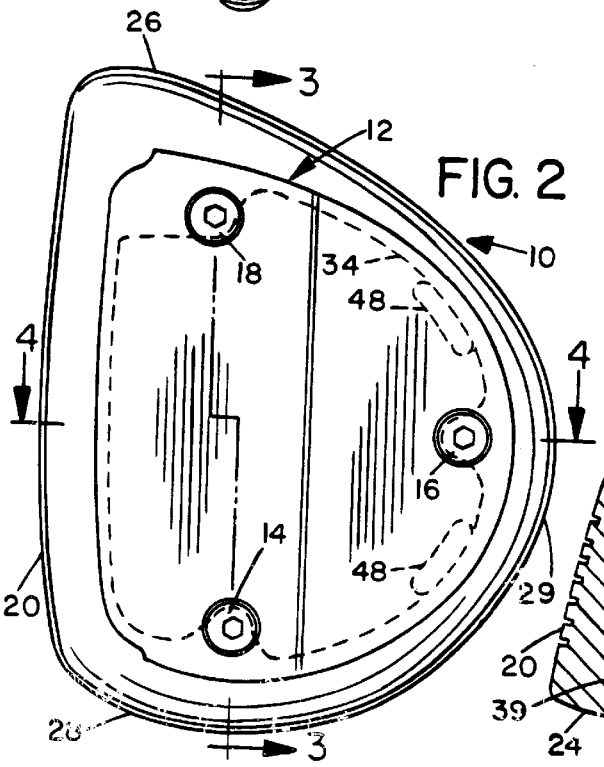
FIG. 2 is a bottom plan view of the club head.
Figure 4:
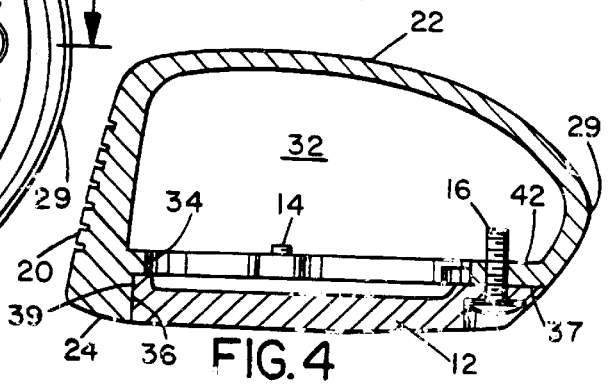
FIG. 4 is a sectional view taken on line 4—4 of FIG. 2.

The peripheral rim 37 in the recessed area of the lower wall has three threaded openings or bores 40,41 and 42 located adjacent the heel, toe and rear wall, respectively, as best illustrated in FIGS. 3 and 4. The sole plate 12 has a corresponding set of three through bores 43,44 and 45 which are positioned for alignment with the respective bores 40,41 and 42 when the sole plate is positioned in the recessed area of the lower wall. The sole plate is secured in the recessed area by means of selected screws which extend through each bore 40,41 and 42 for threaded engagement with the respective aligned hole in rim 37, and into cavity 32 as illustrated in FIGS. 3 and 4. Preferably, each through bore 43,44 and 45 is of stepped diameter as illustrated in FIGS. 3 and 4, with a larger diameter end for receiving the head of each screw so that the screw heads are recessed inwardly away from the lower face or sole 46 of the club head.

A number of different sets of screws of different lengths, and thus different weights, is provided. In FIG. 1, three different length screws 14,16 and 18 of increasing length are shown. Preferably, sets of screws of progressively increasing length are provided. In one example, seven screw sets were provided, with the screw lengths (and weights) in successive sets being ¼ inch (2 grams each), ⅜ inch (2–2.5 grams each), ½ inch (2.5–3 grams each), ⅝ inch (3 grams each), ¾ inch (4 grams each), ⅞ inch (4.5 grams each), and 1 inch (5 grams each). The screws may be of stainless steel, brass, or other equivalent materials. Any combination of three screws may be selected for securing the sole plate to the body of the club head, for example three screws which are all of different length and weight, as illustrated in the drawings, or three screws from the same set which are of the same weight, or two screws which are the same weight and one of different weight. The total weight added to the body by the screws ranges from a minimum of 6 grams if three of the shortest screws are used, to a maximum of 15 grams if three screws of the longest length and greatest weight are used, and can be incrementally increased from the minimum weight to the maximum weight in steps of 0.5 to 1 gram. Since the difference between successive swing weights in golf clubs is two grams, it can be seen that this adjustable weighting system can be used to change swing weight in the same club by up to close to five swing weights or 10 grams.

In addition to allowing swing weight to be adjusted readily in the same club, this system allows weight distribution about the club head to be adjusted by using different weight screws at the three hole positions. For example, in the illustrated embodiment a shorter screw 14 is used at the toe and a longer screw 18 is used at the heel, moving weight from toe to heel. Additionally, a screw 16 which is longer than screw 14 is used at the rear, moving some weight from the front face towards the rear of the club head. Any screw from any of the seven sets may be used at any of the three positions, providing a very large number of possible different weight distributions, and a large degree of adjustability in the same club head, while maintaining an optimum total weight. By using different weight screws at the different positions, the position of the center of gravity as well as the size of the sweet spot, and the overall "feel" and playing characteristics of the club can be readily adjusted. If the club does not feel quite right to a player, they can easily change one or more of the screw weights until they are happy with the club performance. By providing a heavier screw at the rear of the head, the gear effect is increased and the launch angle will also be increased. A player who tends to hit the ball towards the toe of the club can put a heavier screw at the toe and lighter screws elsewhere in order to compensate and move the sweet spot closer to the heel. Thus the club is easily adjustable to an individual player's style.

In the illustrated embodiment, the weight adjustment screws also have the function of securing the sole plate to the body of the club head. Preferably, interlocking formations are provided for releasably holding the sole plate in position as the screws are secured. In the illustrated embodiment, the sole plate is an interference fit in the recessed area of the lower wall by means of the lugs 48 which extend into opening 34 and push the front face up against the rim face behind front face 20. This ensures that the screws can be readily changed without the sole plate falling out of the recess, should a player wish to adjust the weighting.

It will be understood that the same system may be used in a single piece, solid or hollow club head without a separate sole plate, in which case the screws would have the sole function of weight adjustment. In a single piece hollow head, threaded holes are formed through the lower wall into the central cavity in a similar manner to holes 40,41 and 42, and the selected screws are simply threaded through these holes. In a single piece solid head, threaded bores extend inwardly through the sole of the club head which are as long as the maximum length screw in the system, and selected length screws can be engaged in the bores. If the body 10 were solid rather than having an internal cavity 32, a similar arrangement could be used by forming the appropriate length threaded bores into the body. However, the hollow cavity 32 is advantageous for this adjustment system since it allows different length screws to be readily accommodated, since the screw ends simply project into the cavity by differing amounts, and the only limitation on maximum screw length is the height of the cavity itself.

Although three screws are used in the illustrated embodiment, it will be understood that a greater number of screws may be used in alternative embodiments, simply by providing additional threaded openings around rim 37 and corresponding through bores in the sole plate 12. This will provide for an even greater range of weight adjustment.

The club head itself may be made of any material, although in the preferred embodiment it is of forged aluminum alloy material, which is relatively lightweight and therefore leaves a larger amount of weight for distribution about the club head, as described in our co-pending application entitled "Golf Club Head with Perimeter Weighting," filed on even date herewith, the contents of which are incorporated herein by reference. Thus, the body 10 may have a certain amount of fixed perimeter weighting provided by suitable machining of the cavity 32 to provide different wall thicknesses at different locations about the body, such as thicker walls at the heel and toe for increased sweet spot. The adjustable screw weighting system of this invention can then be used to further enhance the peripheral weighting or to vary the weighting as desired.

Although a preferred embodiment of the invention has been described above by way of example only, it will be understood by those skilled in the field that modifications may be made to the disclosed embodiment without departing from the scope of the invention, which is defined by the appended claims.

We claim:

1. A golf club head, comprising:

a body having a front striking face, a rear wall, an upper wall, a lower wall, a heel and a toe, the body characterized by an empty internal cavity and the lower wall having a plurality of threaded openings extending into said internal cavity at selected positions on the periphery of the lower wall;

a separate sole plate for securing to the lower wall of the body, the sole plate having an equal number of through bores on the periphery thereof for alignment with respective threaded openings extending into said internal cavity when the sole plate is positioned against the lower wall; and a plurality of screws for selective engagement through said bores into respective aligned openings to secure the sole plate to the lower wall of the body, the screws including a plurality of sets of screws of different weight, whereby the screw weight at each position on the sole plate and lower wall can be selected in order to control the total club weight and weight distribution across the club head.

2. The head as claimed in claim 1, wherein the body has an empty internal cavity, and the selected screws extend through said bores and aligned openings into said cavity.

3. The head as claimed in claim 1, wherein the screws in different sets are of different lengths.

4. The head as claimed in claim 3, wherein the screw length varies from ¼ inch to 1 inch.

5. The head as claimed in claim 1, wherein the screw weight varies from 2 grams to 5 grams.

6. The head as claimed in claim 1, wherein each screw has an enlarged head and a threaded shaft, the sole plate has an outer face forming the sole of the club head and an inner face for engagement with said lower wall, and said through bores are of stepped diameter including a larger diameter portion extending from said outer face for receiving the head of a selected screw and a smaller diameter portion through which the screw shaft extends.

7. The head as claimed in claim 1, wherein there are three threaded openings, comprising a first opening adjacent the heel, a second opening adjacent the toe, and a third opening adjacent the rear of the body.

8. The head as claimed in claim 1, wherein the lower wall of the body has a recess and the sole plate is shaped and dimensioned for fitting in said recess, and said sole plate and recessed lower wall have interlocking formations for releasably locking said sole plate in said recess while said screws are secured through said bores and aligned holes.

9. A method of adjusting the weight and weight distribution of a golf club head, comprising the steps of:

forming a golf club head having an empty internal cavity. a lower wall and a separate sole plate for securing to the lower wall of the body, providing the lower wall of the body with a plurality of threaded openings extending into said internal cavity at selected positions on the periphery of the lower wall;

providing the sole plate with through bores for alignment with the respective threaded openings;

positioning the sole plate against the lower wall with each through bore in alignment with a respective one of the threaded openings;

providing sets of screws of different weights; and securing the sole plate to the body by selectively engaging screws of selected weight through the bores and into the respective aligned openings to secure the sole plate to the body and to control the total club weight and weight distribution across the club head.

10. The method as claimed in claim 9, wherein a series of clubs of successive swing weights is provided by attaching the sole plate of successive clubs to the body with heavier weight screws.

11. The method as claimed in claim 9, wherein the step of securing the sole plate to the body includes selecting a heavier screw for insertion at the rear of the body to add increased weight at the rear of the club.

* * * * *